US010247412B2

(12) United States Patent
Lin

(10) Patent No.: US 10,247,412 B2
(45) Date of Patent: Apr. 2, 2019

(54) AUTOMATIC ASH DISCHARGE DEVICE FOR A BURNER

(71) Applicant: SUNCUE COMPANY LTD., Taichung (TW)

(72) Inventor: Jung-Lang Lin, Taichung (TW)

(73) Assignee: SUNCUE COMPANY LTD., Taichung (TW)

( * ) Notice: Subject to any disclaimer, the term of this patent is extended or adjusted under 35 U.S.C. 154(b) by 532 days.

(21) Appl. No.: 15/044,657

(22) Filed: Feb. 16, 2016

(65) Prior Publication Data

US 2017/0234533 A1 Aug. 17, 2017

(51) Int. Cl.
*F23G 7/10* (2006.01)
*F23J 1/06* (2006.01)

(52) U.S. Cl.
CPC *F23J 1/06* (2013.01); *F23G 7/10* (2013.01); *F23G 2900/7012* (2013.01); *F23J 2700/003* (2013.01)

(58) Field of Classification Search
CPC ..... F23J 1/06
See application file for complete search history.

(56) References Cited

U.S. PATENT DOCUMENTS 5,255,615 A * 10/1993 Magaldi ..... F23J 1/02 110/165 R
5,775,237 A * 7/1998 Reilly ..... F23J 3/06 110/105
7,559,725 B2 * 7/2009 Mathis, Jr. ..... F23J 1/02 198/752.1
8,833,277 B2 * 9/2014 Magaldi ..... F23J 1/02 110/165 R

* cited by examiner

*Primary Examiner* — David J Laux
(74) *Attorney, Agent, or Firm* — Rabin & Berdo, P.C.

(57) ABSTRACT

An automatic ash discharge device for a burner has a furnace base, a duct set, and a discharge set. The furnace base has a combustion chamber, a mounting opening, a discharge mouth, two guiding faces, and multiple inlet holes. The combustion chamber is formed in the furnace base. The guiding faces are formed aslant in the furnace base. The inlet holes are formed through the guiding faces. The duct set is connected to the furnace base and has two casings and a blower. The casings are mounted on the furnace base respectively corresponding to the guiding faces and communicate with the combustion chamber. The blower communicates with the casings. The discharge set is connected to the furnace base and has a receiving tank connected to the furnace base and communicating with the combustion chamber, and a discharge shaft rotatably mounted in the receiving tank.

9 Claims, 5 Drawing Sheets

AUTOMATIC ASH DISCHARGE DEVICE FOR A BURNER

BACKGROUND OF THE INVENTION

1. Field of the Invention

The present invention relates to an automatic ash discharge device, and more particularly to an automatic ash discharge device for a burner that may prevent ashes from accumulating in a hearth of the burner, and may use the ashes to form a combustion space and an ash-discharge space in the burner to enable biomass fuels to burn completely, and may prolong the life and increase the combustion efficiency of the biomass fuels, and may be used environmentally and safely.

2. Description of Related Art

Grains such as rice, wheat or coffee beans need to be processed by a shelling process, and the husks that are shelled from the grains can be used as biomass fuels for a grain dryer. A heat source that is generated by burning the biomass fuels in a conventional grain dryer may be used to dry or adjust the moisture content of the grains, and this may achieve an effect of resource recovery and reuse. The conventional grain dryer has a burner to burn the biomass fuels to generate heat sources, and the heat sources may be used to dry or adjust the moisture content of the grains.

The burner of the conventional grain dryer has a combustion furnace, and the combustion furnace has a hearth horizontally mounted in a bottom of the combustion furnace. Ashes that are generated by the biomass fuels burning in the combustion furnace or the biomass fuels that are incompletely burned may accumulate on the hearth at the same time, and this may affect the combustion efficiency of the biomass fuels. Furthermore, the ashes accumulated on the hearth need clearing by hands after use of the burner over time. However, when users clear the ashes from the hearth of the burner, the ashes may pollute the air during the clearing process, and the biomass fuels that are incompletely burned and accumulated on the hearth may injury the users, and this is unsafe in use. In addition, the ashes or the biomass fuels that are incompletely burned accumulate on the hearth at a high temperature, and this will damage the hearth after a long time of use, and this may increase the cost of using the burner of the conventional grain dryer.

To overcome the shortcomings, the present invention provides an automatic ash discharge device for a burner to mitigate or obviate the aforementioned problems.

SUMMARY OF THE INVENTION

The main objective of the present invention is to provide an automatic ash discharge device for a burner that may prevent ashes from accumulating in a hearth of the burner, and may use the ashes to form a combustion space and an ash-discharge space in the burner to enable biomass fuels to burn completely, and may prolong the life and increase the combustion efficiency of the biomass fuels, and may be used environmentally and safely.

The automatic ash discharge device for a burner in accordance with the present invention has a furnace base, a duct set, and a discharge set. The furnace base has a combustion chamber, a mounting opening, a discharge mouth, two guiding faces, and multiple inlet holes. The combustion chamber is formed in the furnace base and communicates with the mounting opening and the discharge mouth. The guiding faces are formed aslant in the furnace base between the mounting opening and the discharge mouth. The inlet holes are formed through the guiding faces at spaced intervals. The duct set is connected to the furnace base and has two casings and a blower. The casings are securely mounted on the furnace base, are respectively corresponding to the guiding faces, and communicate with the combustion chamber via the inlet holes. The blower communicates with the casings. The discharge set is connected to the furnace base and has a receiving tank and a discharge shaft. The receiving tank is securely connected to the furnace base under the discharge mouth, and communicates with the combustion chamber. The discharge shaft is rotatably mounted in the receiving tank.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1 to 4, an automatic ash discharge device for a burner in accordance with the present invention has a furnace base 10, a duct set 20, and a discharge set 30.

Figure 1:
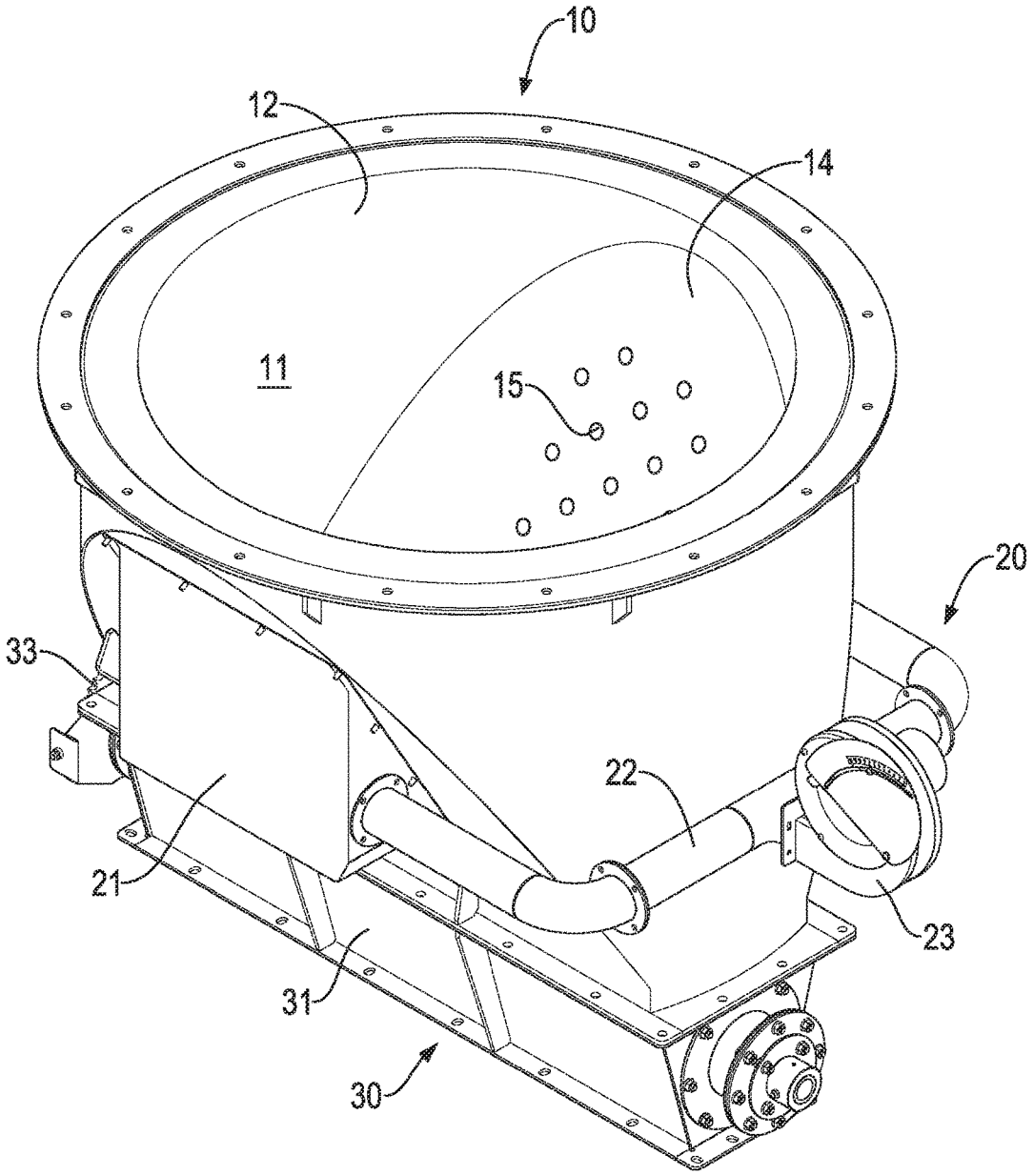
FIG. 1 is a perspective view of an automatic ash discharge device for a burner in accordance with the present invention.
Figure 2:
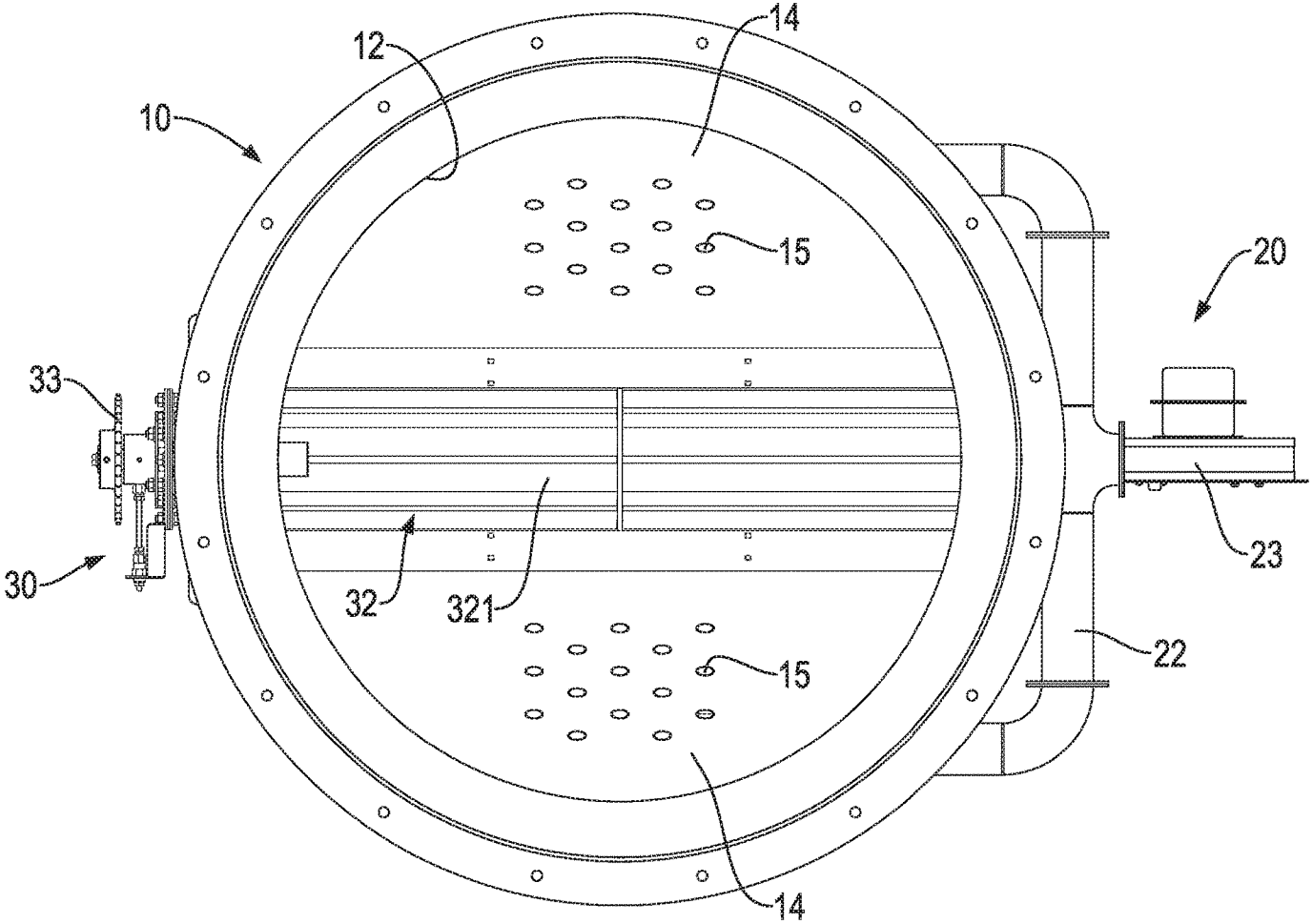
FIG. 2 is a top view of the automatic ash discharge device in FIG. 1.
Figure 3:
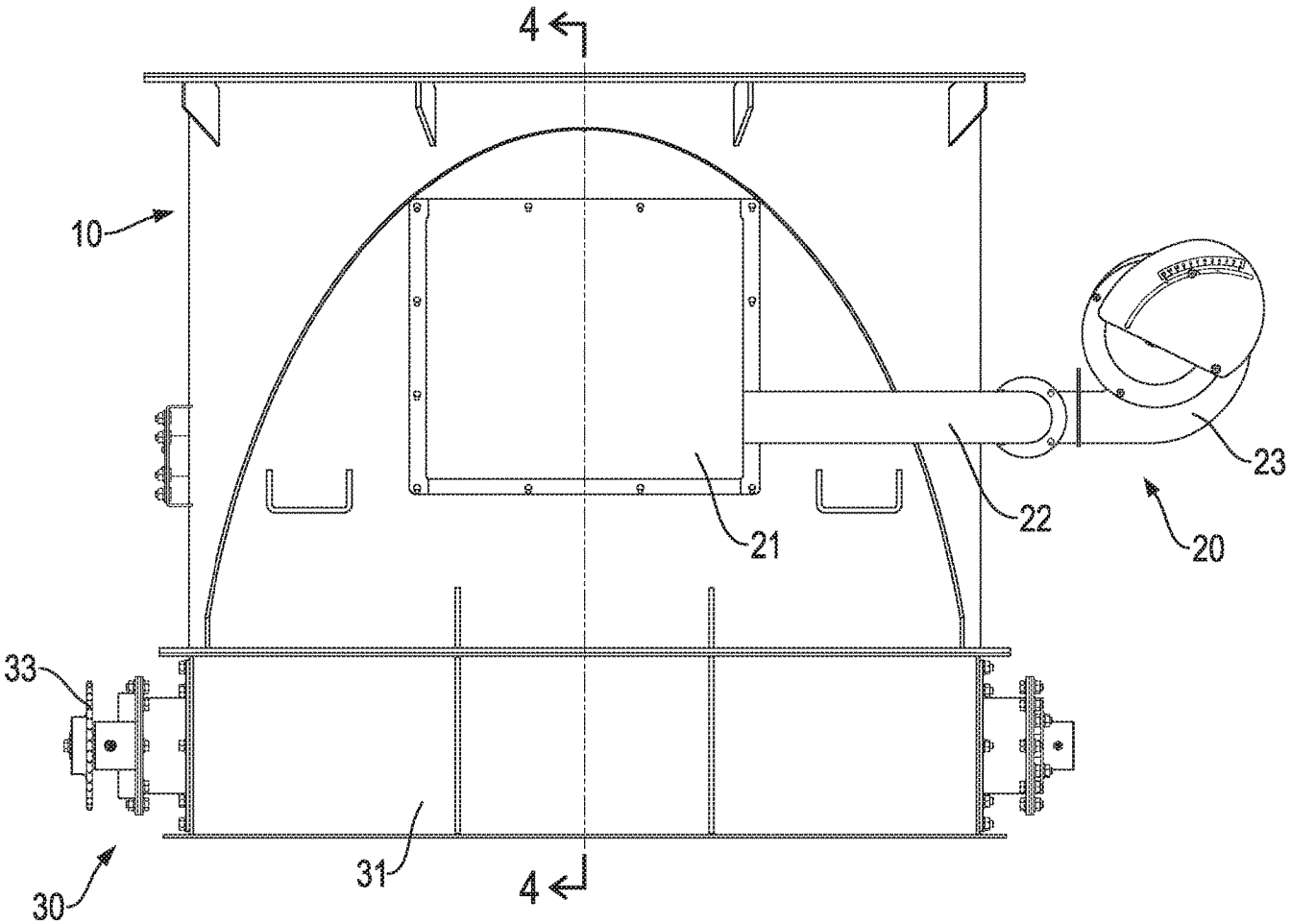
FIG. 3 is a side view of the automatic ash discharge device in FIG. 1.
Figure 4:
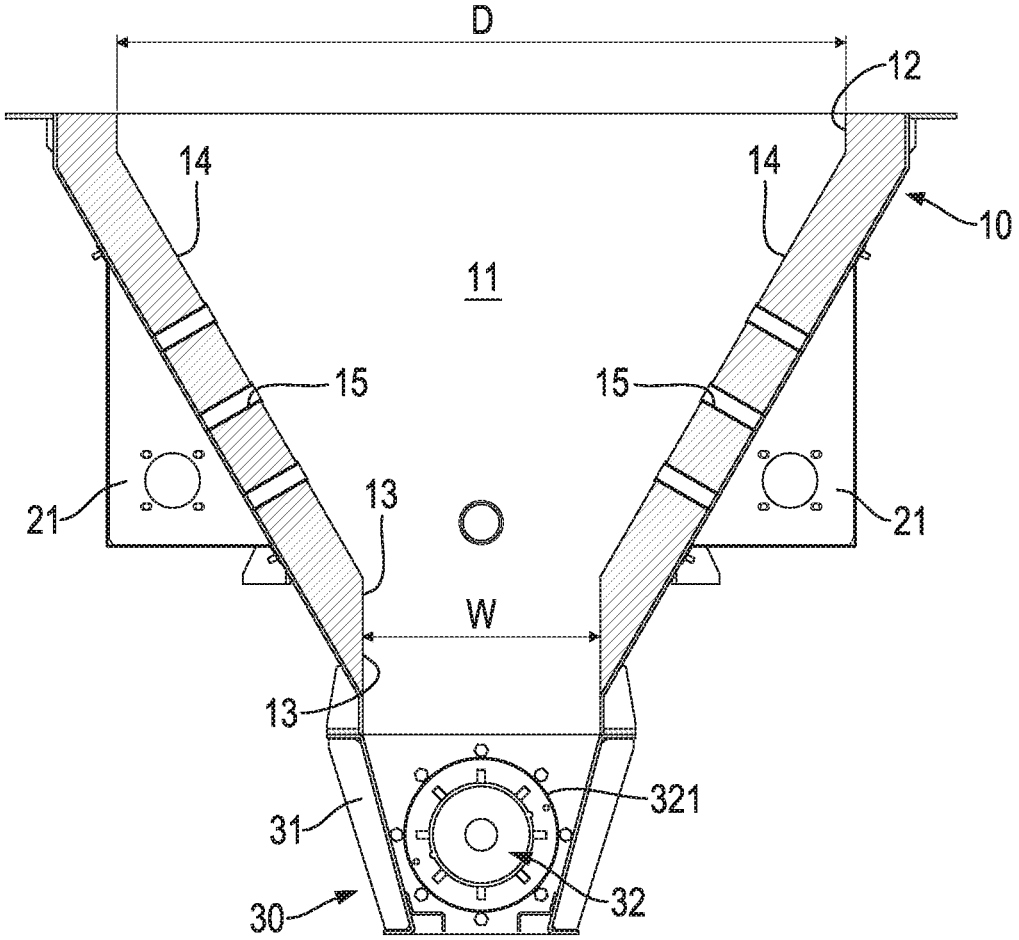
FIG. 4 is a side view in partial section of the automatic ash discharge device along line 4-4 in FIG. 3.
Figure 5:
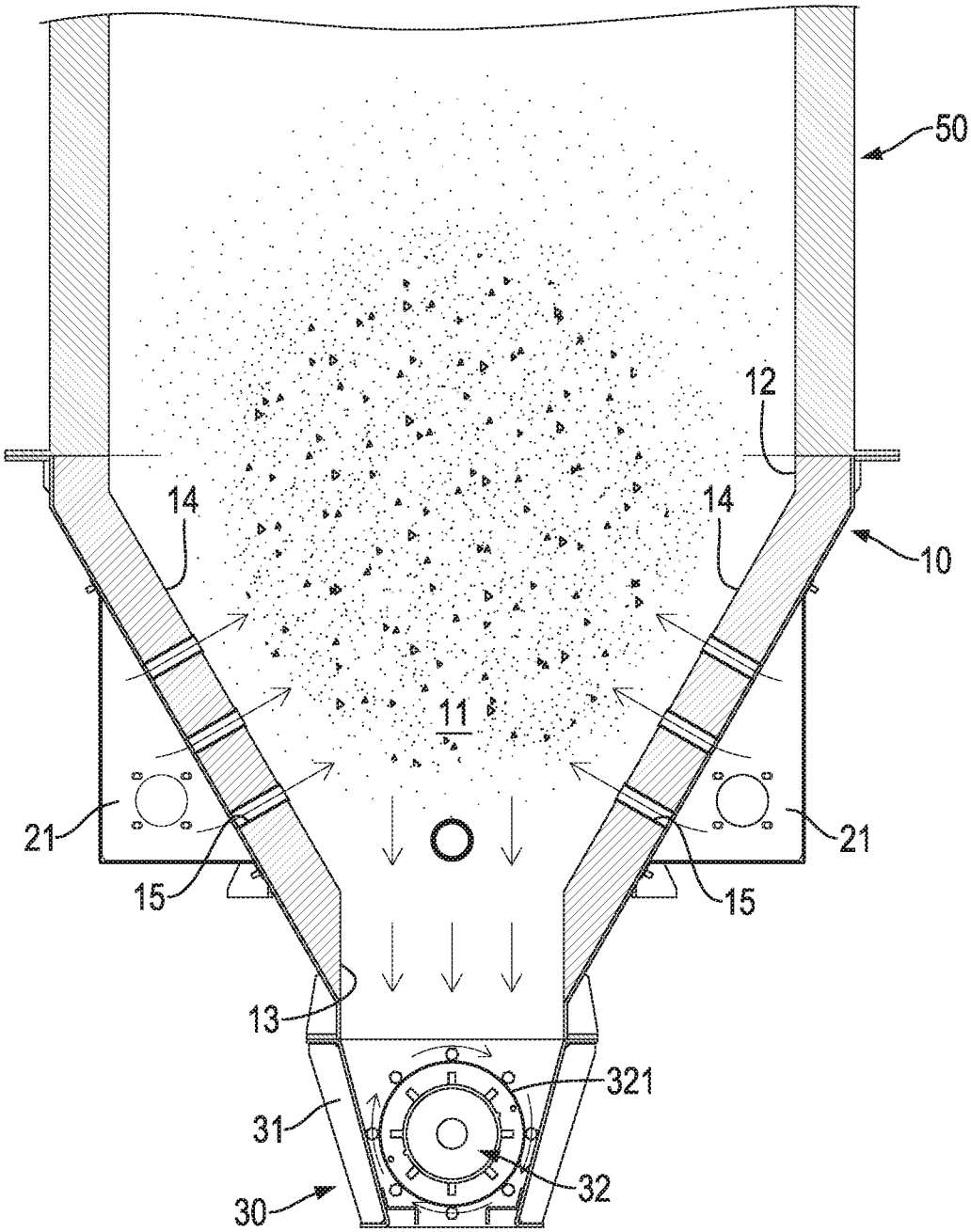
FIG. 5 is an operational side view in partial section of the automatic ash discharge device in FIG. 1.

The furnace base 10 may be a seat that is tapered from a top to a bottom of the seat, and has a top side, a bottom side, an inner surface, an outer surface, a combustion chamber 11, a mounting opening 12, a discharge mouth 13, two guiding faces 14, and multiple inlet holes 15. The combustion chamber 11 is formed in the furnace base 10 between the bottom side and the top side of the furnace base 10 and is used as an ash collection space. With reference to FIG. 5, the top side of the furnace base 10 is connected to a combustion furnace 50 of a burner, the mounting opening 12 is formed through the top side of the furnace base 10 and communicates with the combustion furnace 50 and the combustion chamber 11 of the furnace base 10. In addition, the mounting opening 12 may be arc-shaped and has an inner diameter D.

The discharge mouth 13 may be elongated, is formed through the bottom side of the furnace base 10, and communicates with the combustion chamber 11 of the furnace base 10. The discharge mouth 13 has a width W smaller than the inner diameter D of the mounting opening 12 (that is, D>W). The guiding faces 14 are formed aslant on the inner surface of the furnace base 10 between the mounting opening 12 and the discharge mouth 13 beside two sides of the discharge mouth 13. The inlet holes 15 are formed through the outer surface of the furnace base 10 and the guiding faces 14 at spaced intervals.

The duct set 20 is connected to the furnace base 10 and has two casings 21, a connecting pipe 22, and a blower 23. The casings 21 are securely mounted on the outer surface of the furnace base 10, are respectively corresponding to the guiding faces 14 of the furnace base 10, and communicate with the combustion chamber 11 via the inlet holes 15. The connecting pipe 22 is connected to the casings 21 and has two ends and a middle. The ends of the connecting pipe 22 are respectively connected to the casings 21. The blower 23 is mounted on the middle of the connecting pipe 22 and communicates with the casings 21 via the ends of the connecting pipe 22. When the blower 23 is operated, the external air may be transmitted into the combustion chamber 11 of the furnace base 10 via the connecting pipe 22, the casings 21, and the inlet holes 15.

The discharge set 30 is connected to the furnace base 10 below the duct set 20 and has a receiving tank 31, a discharge shaft 32, and a rotating wheel 33. The receiving tank 31 is securely connected to the bottom side of the furnace base 10 under the discharge mouth 13, and communicates with the combustion chamber 11 of the furnace base 10 via the discharge mouth 13. In addition, the receiving tank 31 may be a box that is tapered from a top to a bottom of the box.

The discharge shaft 32 is rotatably mounted in the receiving tank 31 and has an outer end extending out of the receiving tank 31. When the discharge shaft 32 is rotated relative to the receiving tank 31, ashes that are generated in the furnace base 10 and collected in the receiving tank 31 are discharged out of the receiving tank 31 automatically. Furthermore, the discharge shaft 32 has an external surface and multiple discharge recesses 321. The discharge recesses 321 are formed in the external surface of the discharge shaft 32 at spaced intervals. In addition, the discharge shaft 32 may be a rotating shaft.

The rotating wheel 33 is securely mounted around the outer end of the discharge shaft 32 and is rotated by an external drive device to enable the discharge shaft 32 to rotate relative to the receiving tank 31. Furthermore, the rotating wheel 33 may be a gear wheel or a pulley wheel.

In use, with reference to FIG. 5, the furnace base 10 is securely mounted on a bottom of the combustion furnace 50 of the burner. When the biomass fuels are burned in the combustion furnace 50 to generate ashes, the ashes are transported into the receiving tank 31 of the discharge set 30 via the guiding faces 14 and the discharge mouth 13 of the furnace base 10, and the guiding faces 14 are inclined and may provide a guiding effect to the ashes. In the furnace base 10, the combustion chamber 11 is used as an ash collection space, and the ash collection space can be used to form and isolate a combustion space and an ash-discharge space in the combustion furnace 50 of the burner, and this may prevent the furnace base 10 from damage by the ashes at high temperature and may prolong the life of the combustion furnace 50 and the furnace base 10.

Furthermore, when the biomass fuels are not burned completely in the combustion furnace 50 and the combustion chamber 11 and are transported toward the discharge set 30, the blower 23 of the duct set 20 is operated to enable the external air to transmit into the combustion chamber 11 of the furnace base 10 via the connecting pipe 22, the casings 21, and the inlet holes 15 at the guiding faces 14. Since the guiding faces 14 are formed inclined in the inner surface of the furnace base 10, the external air may flow upwardly to enable the biomass fuels that are not burned completely to burn again, and this may increase the combustion efficiency of the biomass fuels. In addition, the biomass fuels that are not burned completely may not move into the receiving tank 31 of the discharge set 30 and this may prevent the biomass fuels that are not burned completely from burning in the receiving tank 31.

Additionally, the ashes are directly moved into the receiving tank 31 via the discharge mouth 13 or are moved along the guiding faces 14 into the receiving tank 31 via the discharge mouth 13. When the ashes that are accumulated in the receiving tank 31 reach a certain amount, the rotating wheel 33 is rotated by the external drive device to enable the discharge shaft 32 to rotate relative to the receiving tank 31 to move the ashes in the discharge recesses 321 out of the receiving tank 31 automatically, and the users need not clear the ashes by hands and this may also prevent the ashes from polluting the air during the discharge process. Furthermore, the automatic ash discharge device may clear the ashes automatically and may prevent users from getting hurt by the ashes that are not burned completely, and this is environmentally friendly and safe in use.

According to the above-mentioned statements, the automatic ash discharge device for a burner as described has the following advantages.

1. In use, the furnace base 10 of the automatic ash discharge device is connected to the bottom of the combustion furnace 50 of the burner, and the guiding faces 14 are formed inclined in the furnace base 10 and may guide the ashes that are generated after burning the biomass fuels to move into and accumulate in the receiving tank 31 of the discharge set 30 via the discharge mouth 13. In addition, the ashes in the ash collection space may be used to form and isolate a combustion space and an ash-discharge space in the combustion furnace 50 of the burner. Then, the biomass fuels may be burned in the combustion space and the ashes may be moved into the receiving tank 31 via the ash collection space, and this may prevent the furnace base 10 from damage by the ashes at high temperature and may prolong the life of the combustion furnace 50 and the furnace base 10.

2. When the biomass fuels are not burned completely in the combustion furnace 50 and the combustion chamber 11 and are transported toward the discharge set 30, the blower 23 of the duct set 20 is operated to enable the external air to transport into the combustion chamber 11 of the furnace base 10 via the connecting pipe 22, the casings 21, and the inlet holes 15 at the guiding faces 14. Since the guiding faces 14 are formed inclined in the inner surface of the furnace base 10, the external air may flow upwardly to enable the biomass fuels that are not burned completely to burn again, and this may increase the combustion efficiency of the biomass fuels. In addition, the biomass fuels that are not burned completely may not move into the receiving tank 31 of the discharge set 30 and this may prevent the biomass fuels that are not burned completely from burning in the receiving tank 31.

3. After burning, the ashes are directly moved into the receiving tank 31 via the discharge mouth 13 or are moved along the guiding faces 14 into the receiving tank 31 via the discharge mouth 13. When the ashes that are accumulated in the receiving tank 31 reach a certain amount, the rotating wheel 33 is rotated by the external drive device to enable the discharge shaft 32 to rotate relative to the receiving tank 31 to move the ashes in the discharge recesses 321 out of the receiving tank 31 automatically, and users need not clear the ashes by hands and this may also prevent the ashes from polluting the air during the discharge process. Furthermore, the automatic ash discharge device may clear the ashes automatically and may prevent users from getting hurt by the ashes that are not burned completely, and this is environmentally friendly and safe in use.

Even though numerous characteristics and advantages of the present invention have been set forth in the foregoing description, together with details of the structure and features of the invention, the disclosure is illustrative only.

Changes may be made in the details, especially in matters of shape, size, and arrangement of parts within the principles of the invention to the full extent indicated by the broad general meaning of the terms in which the appended claims are expressed.

What is claimed is:

1. An automatic ash discharge device for a burner having:

a furnace base having a top side;

a bottom side;

an inner surface;

an outer surface;

a combustion chamber formed in the furnace base between the bottom side and the top side of the furnace base and used as an ash collection space;

a mounting opening formed through the top side of the furnace base and communicating with the combustion chamber;

a discharge mouth formed through the bottom side of the furnace base, communicating with the combustion chamber, and having two sides;

two guiding faces formed aslant on the inner surface of the furnace base between the mounting opening and the discharge mouth beside the two sides of the discharge mouth; and multiple inlet holes formed through the outer surface of the furnace base and the guiding faces at spaced intervals;

a duct set connected to the furnace base and having two casings securely mounted on the outer surface of the furnace base, respectively corresponding to the two guiding faces of the furnace base, and communicating with the combustion chamber via the inlet holes;

a blower communicating with the casings to enable external air to transmit into the combustion chamber of the furnace base via the casings and the inlet holes at the guiding faces; and a connecting pipe connected to the casings and the blower and having two ends respectively connected to the casings; and a middle;

wherein the blower is mounted on the middle of the connecting pipe and communicates with the casings via the ends of the connecting pipe;

a discharge set connected to the furnace base below the duct set and having a receiving tank securely connected to the bottom side of the furnace base under the discharge mouth, and communicating with the combustion chamber of the furnace base via the discharge mouth; and a discharge shaft rotatably mounted in the receiving tank.

2. The automatic ash discharge device as claimed in claim 1, wherein the furnace base is a seat that is tapered from a top to a bottom of the seat;

the mounting opening is in an arc shape and has an inner diameter; and the discharge mouth has a width smaller than the inner diameter of the mounting opening.

3. The automatic ash discharge device as claimed in claim 2, wherein the discharge shaft has an external surface; and multiple discharge recesses formed in the external surface of the discharge shaft at spaced intervals.

4. The automatic ash discharge device as claimed in claim 3, wherein the discharge shaft has an outer end extending out of the receiving tank; and the discharge set has a rotating wheel securely mounted around the outer end of the discharge shaft.

5. The automatic ash discharge device as claimed in claim 4, wherein the rotating wheel is a gear wheel or a pulley wheel.

6. The automatic ash discharge device as claimed in claim 5, wherein the receiving tank is a box that is tapered from a top to a bottom of the box.

7. The automatic ash discharge device as claimed in claim 6, wherein the discharge shaft is a rotating shaft.

8. The automatic ash discharge device as claimed in claim 1, wherein the discharge shaft has an outer end extending out of the receiving tank; and the discharge set has a rotating wheel securely mounted around the outer end of the discharge shaft.

9. The automatic ash discharge device as claimed in claim 8, wherein the rotating wheel is a gear wheel or a pulley wheel.

* * * * *